US007017311B2

(12) United States Patent
Weiss

(10) Patent No.: US 7,017,311 B2
(45) Date of Patent: Mar. 28, 2006

(54) PANEL FOR MODULAR CONSTRUCTION

(75) Inventor: Nir Weiss, Neohahm (IL)

(73) Assignee: Chagim Nechalim Industries, Ltd., Nechalim (IL)

( * ) Notice: Subject to any disclaimer, the term of this patent is extended or adjusted under 35 U.S.C. 154(b) by 28 days.

(21) Appl. No.: 10/635,047

(22) Filed: Aug. 5, 2003

(65) Prior Publication Data

US 2004/0045225 A1 Mar. 11, 2004

(30) Foreign Application Priority Data

Aug. 14, 2002 (IL) ..... 151244

(51) Int. Cl.
*E04B 1/00* (2006.01)
*E04B 5/00* (2006.01)
*E04B 7/00* (2006.01)

(52) U.S. Cl. ..... 52/271; 52/282.1; 52/282.3; 52/586.1

(58) Field of Classification Search ..... 49/192, 49/193, 382; 52/220.1, 220.8, 242, 238.1, 52/239, 800.1, 800.12, 801.11, 270, 271, 52/288.1, 282.1, 282.3, 588.1, 586.1; 160/135, 160/351; 403/169, 170, 174, 178
See application file for complete search history.

(56) References Cited

U.S. PATENT DOCUMENTS 3,779,177 A * 12/1973 Gigante ..... 108/158.12
4,674,254 A * 6/1987 Koehler et al. ..... 52/506.06
5,009,034 A * 4/1991 Schneider et al. ..... 49/192
5,875,596 A * 3/1999 Muller ..... 52/239
6,314,704 B1 * 11/2001 Bryant ..... 52/745.1

* cited by examiner

*Primary Examiner*—Carl D. Friedman
*Assistant Examiner*—Chi Q. Nguyen
(74) *Attorney, Agent, or Firm*—Ladas and Parry LLP

(57) ABSTRACT

The invention provides a panel for modular construction of partitions and walled structures, the panel having a top, a bottom, two major surfaces and two minor side surfaces, a first of the side surfaces being provided with a first profile and a second of the side surfaces being provided with a second profile, wherein the first profile and the second profile are provided with means for complementary engagement with a profile of an adjacently-positioned panel, and wherein each of the first profiles is provided with two inter-engagement means arranged at angle of about 90° to each other enabling the alternative inter-engagement of two adjacent panels with an angle of 180° therebetween, and at an angle of about 90° therebetween.

12 Claims, 5 Drawing Sheets

Fig. 9
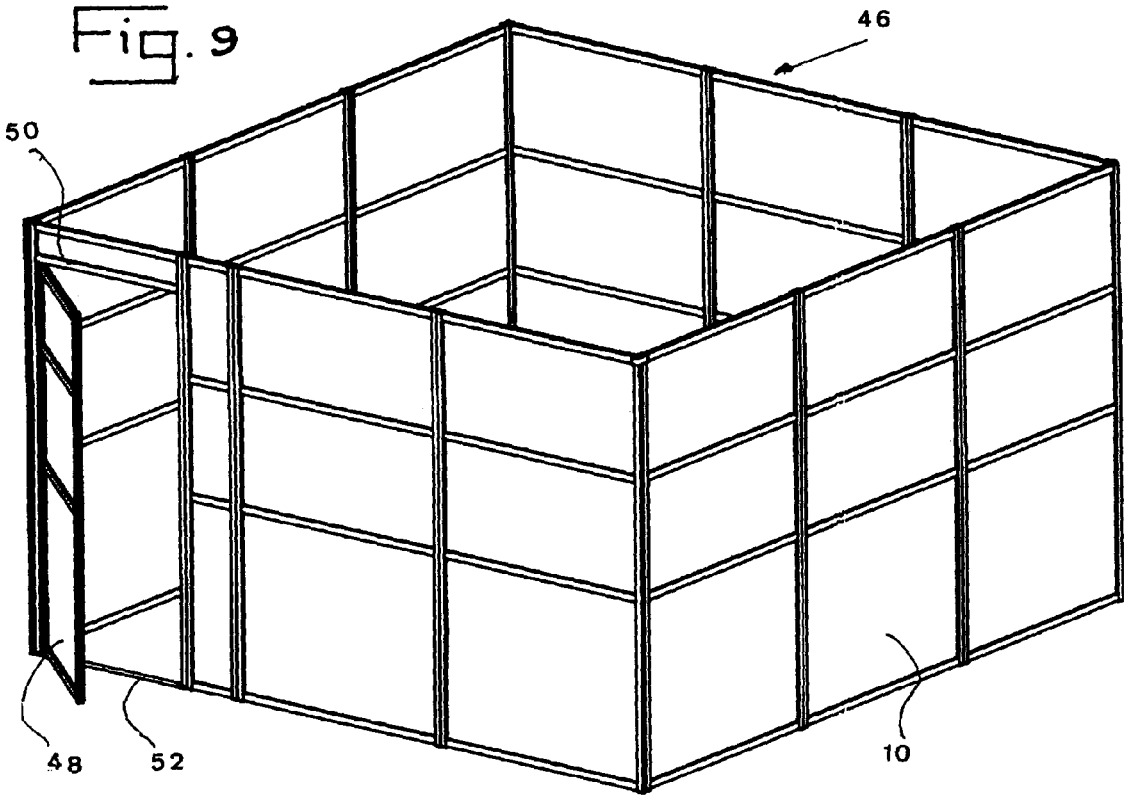
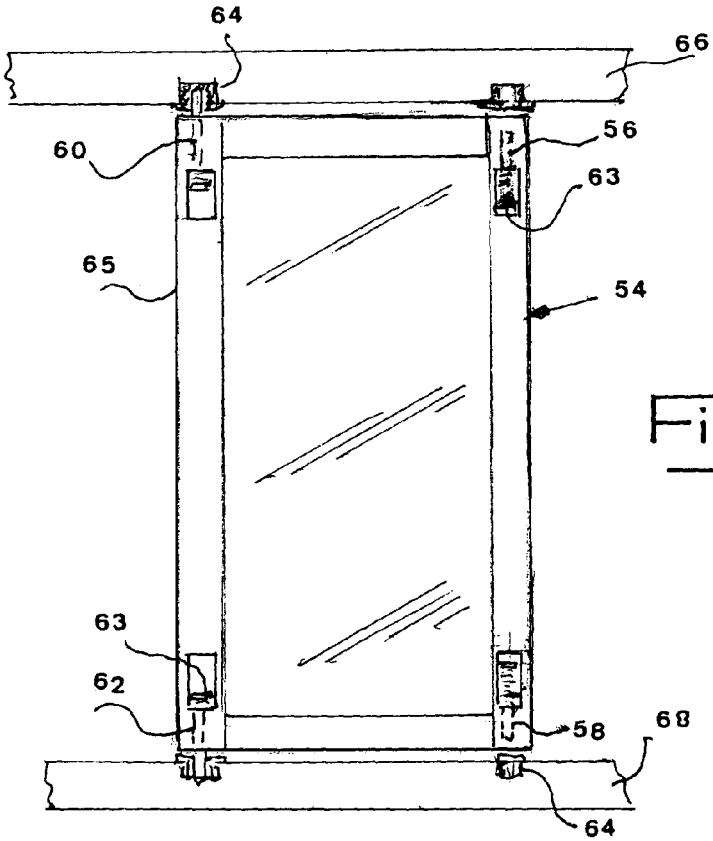
Fig. 10

PANEL FOR MODULAR CONSTRUCTION

FIELD OF INVENTION

The present invention relates to a panel for modular construction of partitions and walled structures.

More particularly, the invention provides a panel which is part of a walled partitioning system for offices, exhibition booths, and with the addition of further components also for use as a tabernacle booth (sukka).

BACKGROUND OF THE INVENTION

Partitioning systems commonly comprise interconnectable light-duty panels which are provided with various accessories to extend their usefulness.

Such systems have been in use for many decades, primary applications being the division of office space, the construction of temporary buildings, and the erection of booths at exhibitions.

The state of the art can be assessed by review of partition systems as disclosed in recent U.S. Pat. Nos. 5,905,229 and 6,218,612 B1 to McKitrick et al., 6,009,930 to Jantschek, 6,047,508 to Goodman et al., 6,076,308 to Lyon et al., 6,112,851 to Sugimoto et al., and 6,131,347 to Hornberger et al.

While each system has it's appropriate applications, many systems suffer from serious drawbacks, among which are lack of strength to resist wind forces in exterior applications, difficulties in forming corners, a requirement for too many special parts, awkward assembly procedures, and the inability of profiles to interconnect so as to allow panels to take up either a straight line or perpendicular formation. Many systems require endwise assembly in order to achieve interlocking between adjacent panels, such assembly being tiresome and time consuming.

No prior-art partitioning system relates to the specific requirements of a booth (sukka) intended for use on the Jewish feast of Tabernacles. There exists an active demand for the erection of a roofless temporary dwelling area for one week in the autumn to fulfill the biblical commandment "You shall dwell in booths for seven days . . . " (Leviticus, 24, 42). The sukka is erected in any available open space such as a courtyard, parking area, open balcony or flat roof. The top of the sukka has an upper framework made of wooden beams, these serving to support light tree branches or a mat woven from a plant or reed. The size of the sukka may vary from a minimum of 70 cm square to an area hundreds of times larger such as a sukka typically erected by a hotel to cater for its guests. Usually the sukka is dismantled after use and is stored in compact form for reuse in the following year.

Being exposed to the elements, the sukka walls need to be capable of resisting whatever wind that can be expected, and in cold climates provide some degree of insulation against the cold.

Bearing in mind these requirements it is clear that a modular construction system is preferable for the construction of a sukka as compared to the more prevalent system of nailing together an assorted collection of wooden boards tarpaulins or even metal sheets.

It is therefore one of the objects of the present invention to obviate the disadvantages of prior art partitioning systems and to provide a panel which can be interconnected with a further panel in a straight line or at the perpendicular.

It is a further object of the present invention to provide such interconnection by direct edge-to-edge assembly without the inconvenience of endwise assembly.

Yet a further object of the present invention is to provide an embodiment which meets the particular requirements of a sukka of any size.

The present invention achieves the above objects by providing a panel for modular construction of partitions and walled structures, said panel having a top, a bottom, two major surfaces and two minor side surfaces, a first of said side surfaces being provided with a first profile and a second of said side surfaces being provided with a second profile, wherein said first profile and said second profile are provided with means for complementary engagement with a profile of an adjacently-positioned panel, and wherein each of said first profiles is provided with two inter-engagement means arranged at angle of about 90° to each other enabling the alternative inter-engagement of two adjacent panels with an angle of 180° therebetween, and at an angle of about 90° therebetween.

In a preferred embodiment of the present invention there is provided a profile for use in a panel for modular construction of partitions and walled structures, said profile being provided with two inter-engagement means arranged at angles of about 90° to each other enabling the alternative inter-engagement of said profile and the panel to which it is attached with an adjacent panel at an angle of 180° therebetween, and at an angle of about 90° therebetween.

In a most preferred embodiment of the present invention there is provided modular system for construction of a sukka including panels as described above, further provided with wooden beams which can be laid in an array over said panels, said beams being supported by the top edges of opposing panels and providing further rigidity to the structure while acting as a support for the sukka roofing material.

Yet further embodiments of the invention will be described hereinafter.

It will thus be realized that the novel device of the present invention serves to provide a set of components which can quickly and easily be assembled into a walled structure of any desired size. The profiles described can be assembled into a panel therebetween to hold a board or multiple strips made of plastic, wood, metal, glass, heat insulation or combinations thereof, dependent on the application.

An important application of the present system is for construction of a firm-walled enclosure ideal for use as a sukka. This can be constructed to any required size simply by adding further panels, and after being used for a week or longer can be easily dismantled. Elderly and infirm people have difficulty in constructing a sukka of presently-known types, and the ease of assembly of the system of the present invention will now enable almost anyone to carry out sukka erection without the need for outside help.

Dismantling after use and putting the components into compact storage pending reuse are easily and quickly effected.

It will be realized that while the present invention is primarily concerned with panels and profiles for erecting a sukka structure, the panels of the present invention can also be used for the partitioning of existing buildings, particularly offices and for subdividing areas for fairs and exhibitions.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

BRIEF DESCRIPTION OF THE DRAWINGS

FIG. 9 is a perspective view of an enclosure, including an entrance door, built using panels according to the present invention;

FIG. 10 is a front elevational view of a door provided with four retractable hinges;

DETAILED DESCRIPTION OF PREFERRED EXEMPLARY EMBODIMENTS

Figure 1:
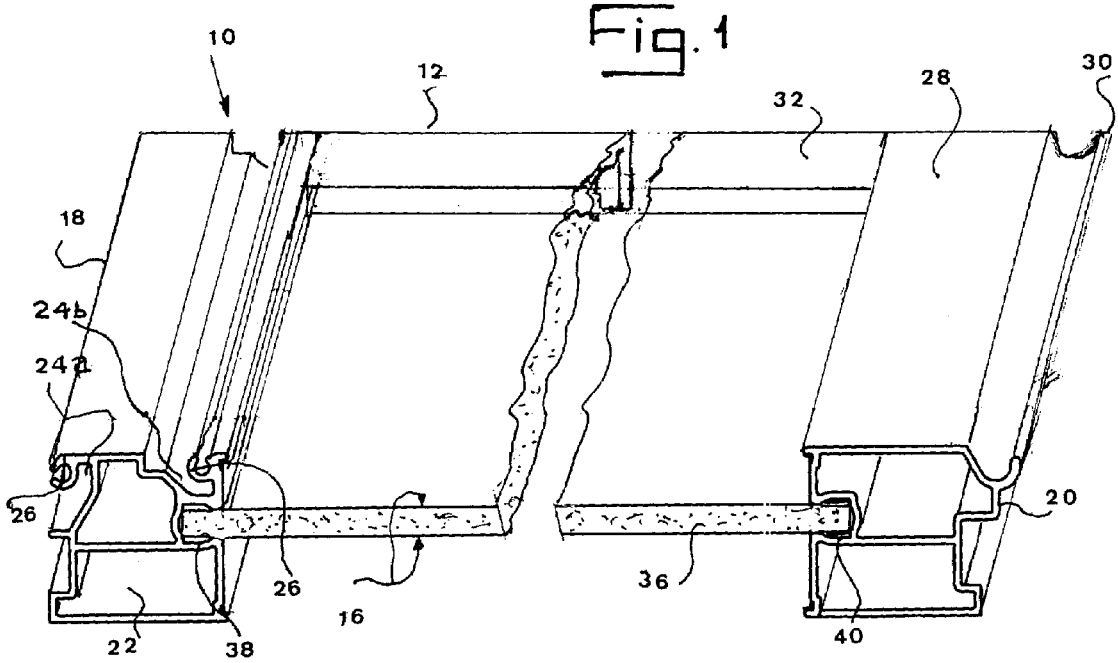
FIG. 1 is a perspective fragmented view of a preferred embodiment of the panel according to the invention.

There is seen in FIG. 1 a panel 10 for modular construction of partitions and walled structures, an example being seen in FIG. 9.

The panel has a top 12, a bottom 14 (seen in FIG. 2), two major surfaces 16 and two minor side surfaces 18, 20.

A first of the panel side surfaces 18 is fitted with a first profile 22, which is provided with two elongated hollowed-out bead-like means 26 arranged at an angle of about 90° to each other.

Figure 3:
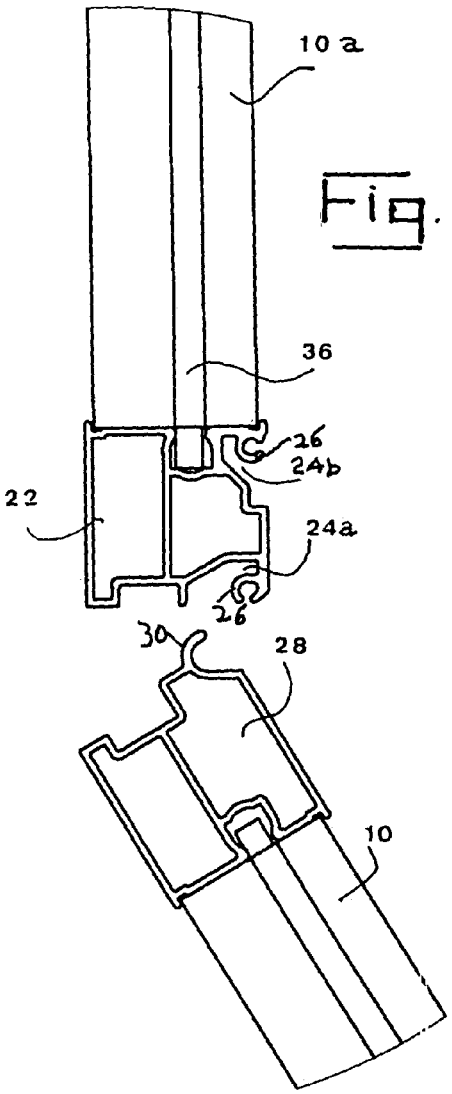
FIGS. 3, 4 and 5 are plan views of panels being interconnected in line and at right angles.
Figure 5:
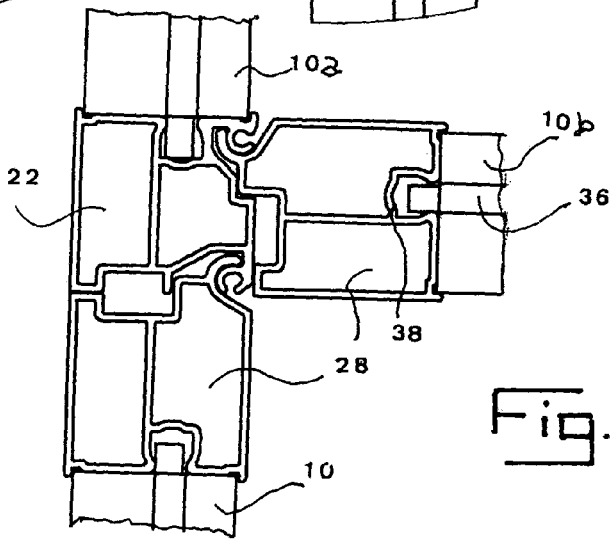

A second of the panel side surfaces 20 is provided with a second profile 28. The second profile 28 has an elongated hook-like means 30 adapted to engage override and interlock with bead-like means 26 for complementary engagement with the first profile 22 of an adjacently-positioned panel 1O*a*, as seen in FIG. 3. As seen in FIG. 5, a structure can be built which includes the inter-engagement of two adjacent panels 10, 10*a* in line and if required also a third panel 10*b* at an angle of 90° to the first panel 10 for forming inner partitions within an erected structure.

The space between opposing profiles 22, 28 is filled by a flat sheet of material 36, or multiple strips made of plastic, wood, metal, glass, heat insulation or combinations thereof, as appropriate for the application and as requested by the end user. All the edge profiles 22, 28, 32, 34 are also provided with a channel 38 to retain sheet material 36. The curved inner sides 40 of the channel 38 provide room for addition of a sealing material, if required.

With reference to the rest of the figures, similar reference numerals have been used to identify similar parts.

Figure 2:
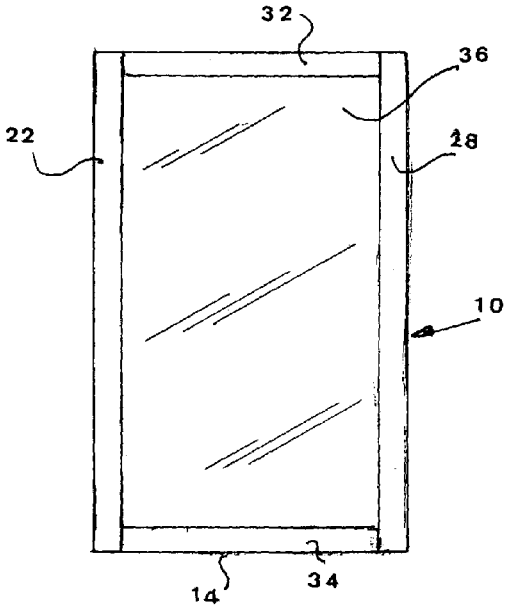
FIG. 2 is a front elevational view of a panel.

Referring now to FIG. 2, there is seen, in non-detailed form, a panel 10 for modular construction, wherein the profiles 22, 28 are substantially co-extensive with the height of the side surface 18, 20 to which they are attached. The full height profiles 22, 28 add to the strength, rigidity and good appearance of the panel 10. The open profile extremities can be plugged, as will be seen in FIG. 6

Figure 4:
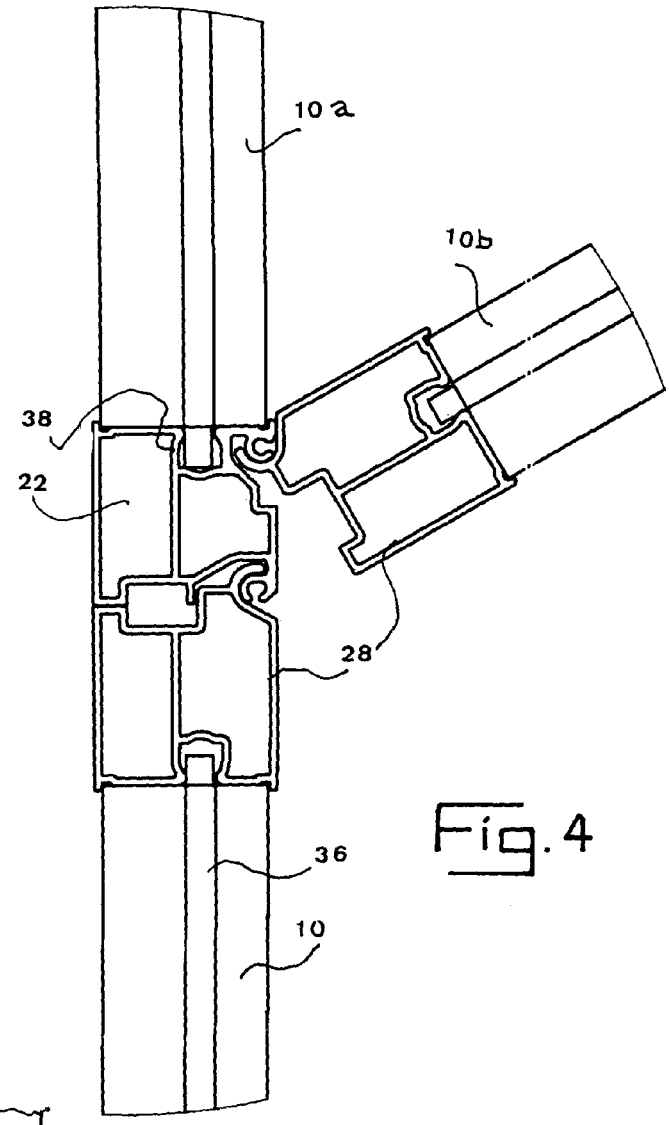

FIGS. 3, 4 and 5 illustrate three panes 10, 10*a*, and 10*b* for modular construction. FIGS. 3 and 4 show how the connections are effected.

The first and the second panels 10, 10*a* inter-engage by the provision in the first profile 22 of a first curved recess 24*a* at the outer edge of the first profile and a second curved recess 24*b* on a side of one of the major surfaces said recesses being formed along a surface of said elongated bead-like means 26 and being sized to receive and retain the curved elongated hook-like means 30 which can be inserted into the first recess 24*a* for inter-connection of adjacent panels 10*a*, 10*b* at an angle of 180° therebetween.

For interconnection of adjacent panels at an angle of 90° therebetween, the elongated hook-like means 30 is inserted in the second curved recess 24*b*.

It is important to note that panel inter-engagement can be effected while the panels to be interconnected are at the same height level. There is no need to slide one profile into the other using the profile open ends.

Figure 6:
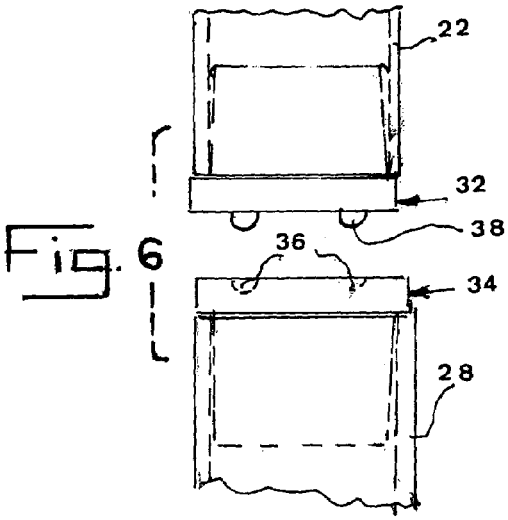
FIG. 6 is a side view of interconnecting plug units.
Figure 7:
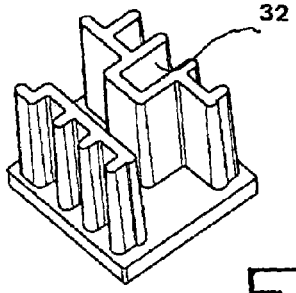
FIG. 7 is a perspective view of one of the plug units.

FIGS. 6 and 7 show an additional accessory for the modular system for partition construction.

Elastomer end plugs 32, 34 are be fitted into the open ends of the first and the second profiles 22, 28. A first end plug 32 has projections 38, and a second end plug 34 has upper recesses 36 matching the projections 38 of the first end plug 32.

Use of these locating devices enables panels 10 to be positioned one on top of the other if a high structure is required, as will be seen for example in FIG. 9.

The plugs 32, 34 used at the bottom 14 (FIG. 2) of a panel can be used to serve as feet.

Figure 8:
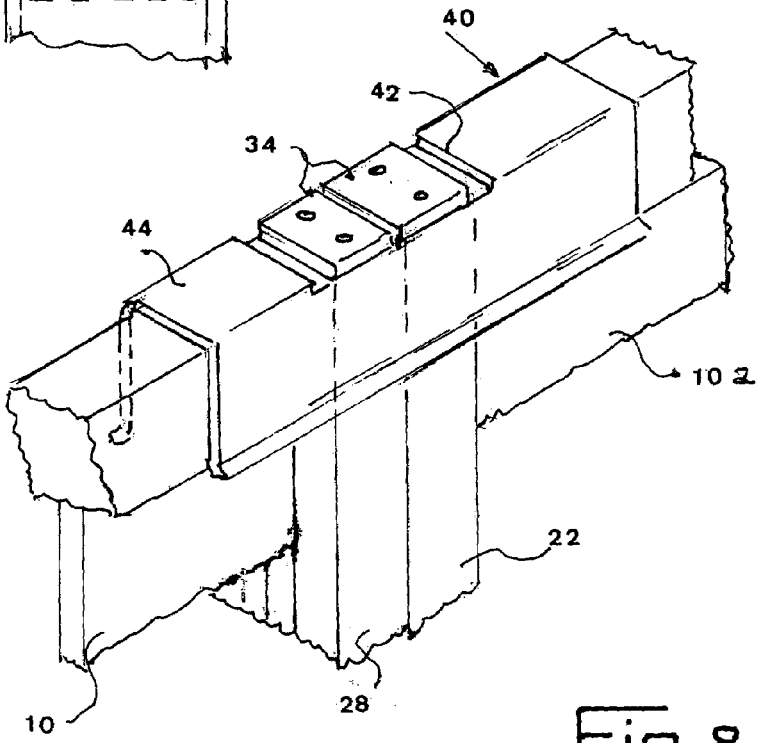
FIG. 8 is a perspective view of a U channel used to retain panels in line.

Seen in FIG. 8 is a further component 40 of a modular system for partition construction. The component 40 is a flat bottom U-shaped element, sized to fit over the panel tops, to retain a pair of adjacent panels 10, 10*a*, at an angle of 180° therebetween.

Advantageously a recess 42 is provided in the flat bottom 44 (appearing as a flat top face) of the U-shaped element 40 to allow passage for end plugs 34.

Referring now to FIG. 9, there is depicted a structure 46 built by using panels 10 of the modular system for partition construction. The panels 10 are built to different sizes and interconnected as described with reference to FIG. 5.

Additionally a door panel 48 is hingedly suspended between an upper 50 and a lower 52 horizontal beam member.

While not shown, it will be understood that once a structure 46 as shown in FIG. 9 is constructed it is then possible to add further internal partitions such as shown in FIG. 4 for subdividing the structure to create separate private alcoves therein.

FIG. 10 shows a door panel 54 provided with four retractable hinge pins 56, 58, 60 62. One retractable hinge pin is disposed proximate to each of the corners of the door panel 54. Each hinge pin has a slide grip 63 for manual operation.

The hinge pins 56–62 when deployed engage bush elements 64 held by the beam members 66, 68. The door panel 54 can be hinged proximate to the right edge when only the right side hinge pins 56, 58 are deployed. In the diagram the door panel shown is hinged proximate to the left edge 65, as both left side hinge pins 60, 62 are deployed. The door panel 54 can be locked by deploying any three hinge pins. Lastly, the door can be removed when all hinge pins are retracted.

Figure 11A:
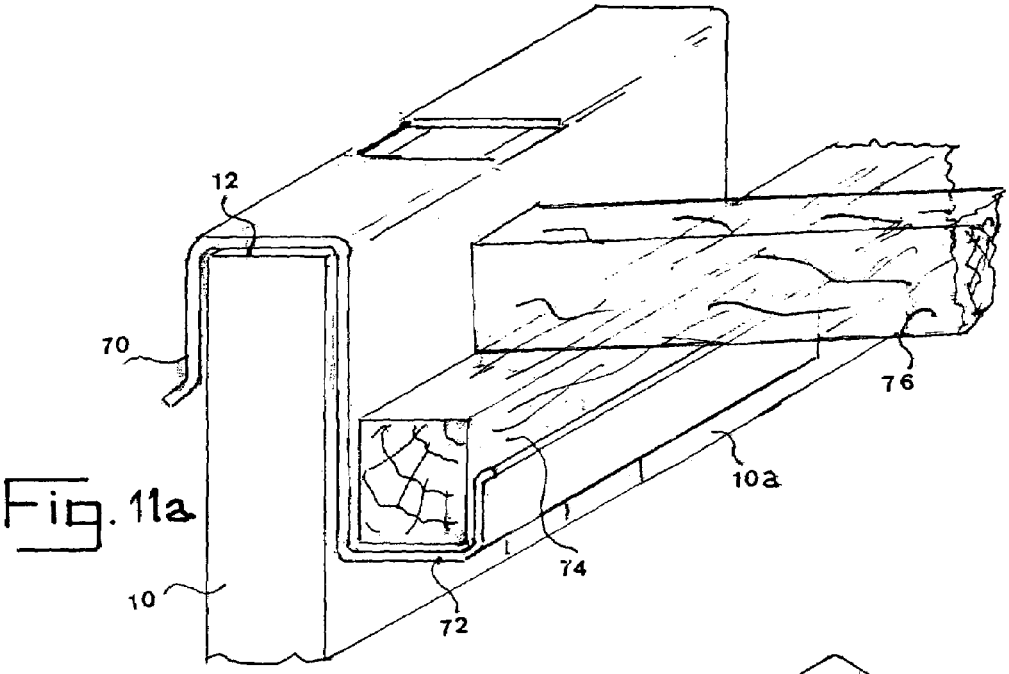
FIG. 11*a* is a perspective view of a U channel extended to hold a wooden beam.

Turning now to FIG. 11*a,* there is seen a detail of a modular system suitable for construction of a sukka. A component 70 is a double flat bottom U-shaped element, sized to fit over the panel tops 12 and retain a pair of adjacent panels 10, 10*a,* at an angle of 180° therebetween. The lower part of the U 72 provides support for a horizontal wooden beam 74, well below the top 12 of the panels 10. The horizontal wooden beam 74 now can support an array of further wooden beams 76, at a level below the panel top 12. This is advantageous as the loose items on the sukka roof get some protection from wind.

Figure 11B:
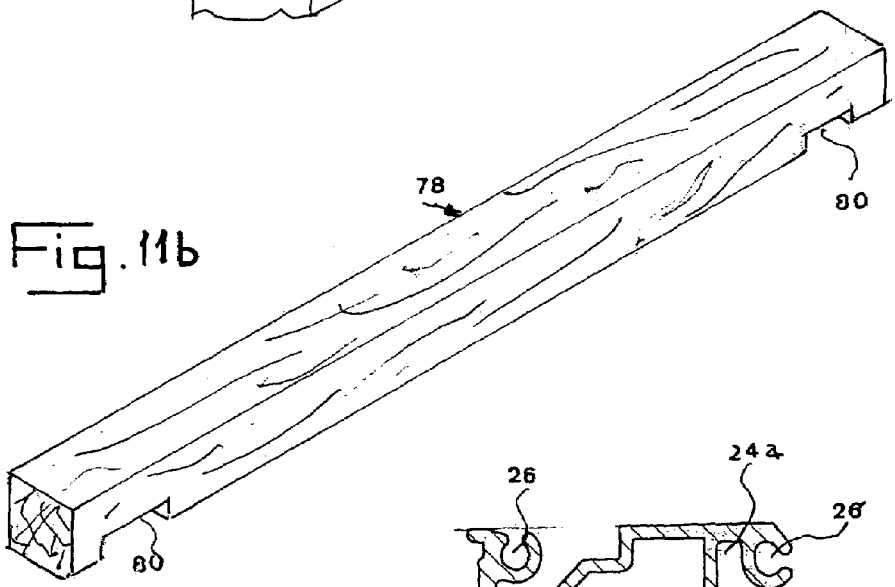
FIG. 11*b* is a perspective view of a wooden beam which can be used in combination with the booth seen in FIG. 9 for construction of a sukka.

In FIG. 11*b* there is seen a further wooden beam 78 having notches 80 proximate to each extremity. The notches 80 are sized to fit over the top 12 of opposite side panels 10. The beams 78 can be used as the final sukka roof if the beams are positioned parallel to each other with only about 1 cm between adjacent beams. Alternatively the beam 78 is used to support further components of the sukka.

Figure 12:
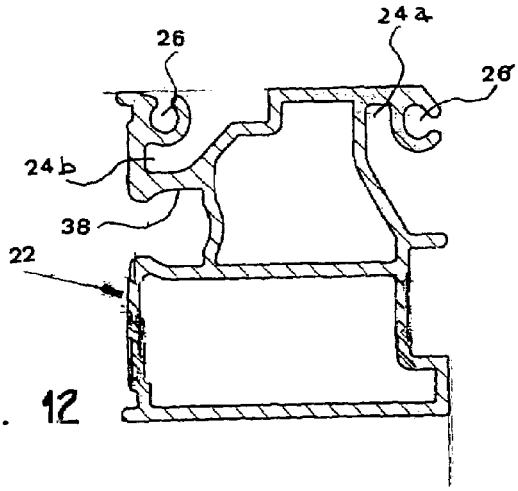
FIG. 12 is a sectional view of a first profiles is provided with two inter-engagement means arranged at angle of 90° to each other.

Lastly referring to FIG. 12, there is depicted in detail the profile 22 for use in a panel 10 for modular construction of partitions and walled structures. The profile is provided with two inter-engagement means 24*a,* 24*b* arranged at angles of about 90° to each other. As can be seen in FIG. 5, this makes possible the alternative inter-engagement of the profile and the panel to which it is attached with an adjacent panel at an angle of 180° therebetween, and at an angle of 90° therebetween.

While the profile 22 can be made of PVC or other materials, the preferred material is an extrusion of aluminium alloy such as 6063-T5. The profile provides the panel both strength and good appearance. For long-term appearance-critical applications the profiles are anodized with/without color or painted and oven baked at the manufacturing plant as specified by the architect or end user.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A panel system for modular construction of partitions and walled structures, said panel system having a plurality of panels, each of said panels having a top, a bottom, two major surfaces and two minor side surfaces, a first of said minor side surfaces being provided with an integral first profile and a second of said minor side surfaces being provided with an integral second profile, wherein each of said first profile and said second profile are provided with means for direct complementary engagement with a profile of an adjacently-positioned panel, and wherein said first profile is provided with two substantially identical inter-engagement means arranged at an angle of about 90° to each other enabling direct inter-engagement of said first profile of a first panel with one or two respective second profiles of two adjacent second panels, the arrangement being such that upon inter-engagement between said first panel and one of said second panels an angle of 180° is formed therebetween, and upon inter-engagement between said first panel and a second of said second panels an angle of about 90° is formed therebetween.

2. The panel system for modular construction according to claim 1, wherein said profiles and the minor side surfaces to which they are respectively, integrally attached are substantially co-extensive in height.

3. The panel system for modular construction according to claim 1, wherein a first of the two substantially identical inter-engagement means of said first profile comprises a first curved recess and a second of the two substantially identical inter-engagement means of said first profile is provided with a second substantially identical curved recess and said second profile is provided with a curved extending elongated hook-like means for inserting into said first recess and inter-connection of adjacent panels at an angle of 180° therebetween, and inserting into said second curved recess and inter connection of adjacent panels at an angle of about 90° therebetween.

4. The panel system for partition construction including panels according to claim 1, wherein said first and said second profiles have open ends and wherein said system further comprises elastomer end plugs for fitting into the open ends of said first and said second profiles, a first end plug having upper projections and a second end plug having upper recesses matching said projections of said first end plug.

5. The panel system for partition construction including panels according to claim 1, further provided with flat bottom U-shaped elements sized to fit over said panel tops, to retain a pair of adjacent panels at an angle of 180° therebetween.

6. The panel system for partition construction in according to claim 5, wherein a recess is provided in said flat bottom of said U-shaped element to allow passage for end plugs.

7. The panel system for partition construction including panels according to claim 1, further provided with a door panel having a top, a bottom, two major surfaces and two minor side surfaces hingedly suspended between an upper and lower horizontal beam members, and having four corner areas formed at the respective junctures of said top, bottom and minor side surfaces.

8. The panel system for partition construction including a door panel according to claim 7, wherein said door panel is provided with four retractable hinge pins one retractable hinge pin being proximate to each of the corners of said door panel, said hinge pins when deployed engaging bush elements held by said beam members, said door panel being hinged proximate to a first minor side surface of the door panel when only the hinge pins adjacent said first minor side surface are deployed, said door panel being hinged proximate to a second minor side surface of said door panel when only the hinge pins adjacent said second minor side surface are deployed, said door panel being locked when at least three hinge pins are deployed and being removable when all hinge pins are retracted.

9. The panel system for construction of a walled tabernacle booth structure including panels according to claim 1, further provided with wooden beams which are adapted to be laid in an array over said booth, said beams being supported by opposing panels.

10. The panel system for construction of a walled tabernacle booth structure according to claim 9, further provided with flat bottom U-shaped elements sized to fit over said panel tops to retain a pair of adjacent panels at an angle of 180° therebetween, wherein a leg of said U-shaped element is extended to provide a support and to horizontally hold a wooden beam adjacent to and parallel to said panels at a level lower than said top of said panels.

11. The panel system for construction of a walled tabernacle booth structure according to claim 10, further provided with wooden beams which are adapted to be laid in an array over said wooden beams supported in said extended U-shaped elements located at opposing walls of said booth.

12. The panel system for construction of a walled tabernacle booth structure according to claim 11, wherein said wooden beams are notched at a lower surface adjacent to each wooden beam extremity, said notch being sized to engage said top of said panel.

* * * * *